US006148868A

United States Patent [19]

Kawamura et al.

[11] Patent Number: 6,148,868

[45] Date of Patent: Nov. 21, 2000

[54] REED WITH DOGLEGGED BLADES FOR WATER JET LOOM AND WEAVING METHOD USING THE SAME

[75] Inventors: Masaharu Kawamura; Hideki Kawaminami, both of Osaka; Chitoshi Miyamukai, Ishikawa, all of Japan

[73] Assignee: Teijin Limited, Osaka, Japan

[21] Appl. No.: 09/125,263

[22] PCT Filed: Oct. 24, 1997

[86] PCT No.: PCT/JP97/03872

§ 371 Date: Aug. 12, 1998

§ 102(e) Date: Aug. 12, 1998

[87] PCT Pub. No.: WO98/29589

PCT Pub. Date: Jul. 9, 1998

[30] Foreign Application Priority Data

Mar. 14, 1996 [JP] Japan ..... 8-087403
Dec. 26, 1996 [JP] Japan ..... 8-357649

[51] Int. Cl.[7] ..... D03D 49/62; D03D 47/32

[52] U.S. Cl. ..... 139/192

[58] Field of Search ..... 139/192

[56] References Cited

U.S. PATENT DOCUMENTS

| | | | |
|---|---|---|---|
| 1,686,448 | 10/1928 | Hargrove et al. | 139/192 |
| 3,379,223 | 4/1968 | Fend | 139/192 |
| 3,425,459 | 2/1969 | Volpe | 139/190 |
| 4,478,259 | 10/1984 | Honegger | 139/435 |
| 4,694,867 | 9/1987 | Glendelman et al. . | |
| 5,570,725 | 11/1996 | Musha et al. | 139/192 |

FOREIGN PATENT DOCUMENTS

| | | | |
|---|---|---|---|
| 50-70271 | 6/1975 | Japan | D03D 49/62 |
| 62-133147 | 6/1987 | Japan | D03D 23/00 |
| 63-159545 | 7/1988 | Japan | D02G 3/22 |
| 9-209241 | 8/1997 | Japan . | |

*Primary Examiner*—Andy Falik
*Attorney, Agent, or Firm*—Sughrue, Mion, Zinn, Macpeak & Seas, PLLC

[57] ABSTRACT

A reed attached to a water jet loom has reed blades each having an upper portion which is doglegged toward a cloth-fell relative to each lower portion, wherein each front edge of the doglegged reed blade facing the cloth-fell has a flat outline. A method for weaving a thermoplastic synthetic fiber fabric using the reed on a water jet loom includes preparing warps of thermoplastic synthetic multi-filament yarns each of which has a twisting number of at least 100 per meter or each of which is provided with tie points and substantially zero-twist, and inserting a weft into a weaving shed with a stream of ejected water so that when the reed reaches its retracted position, a distance between the cloth-fell and a contact point intersecting a warp with a reed blade is decreased by using the doglegged reed blades.

5 Claims, 5 Drawing Sheets

FIG. 1-a
PRIOR ART
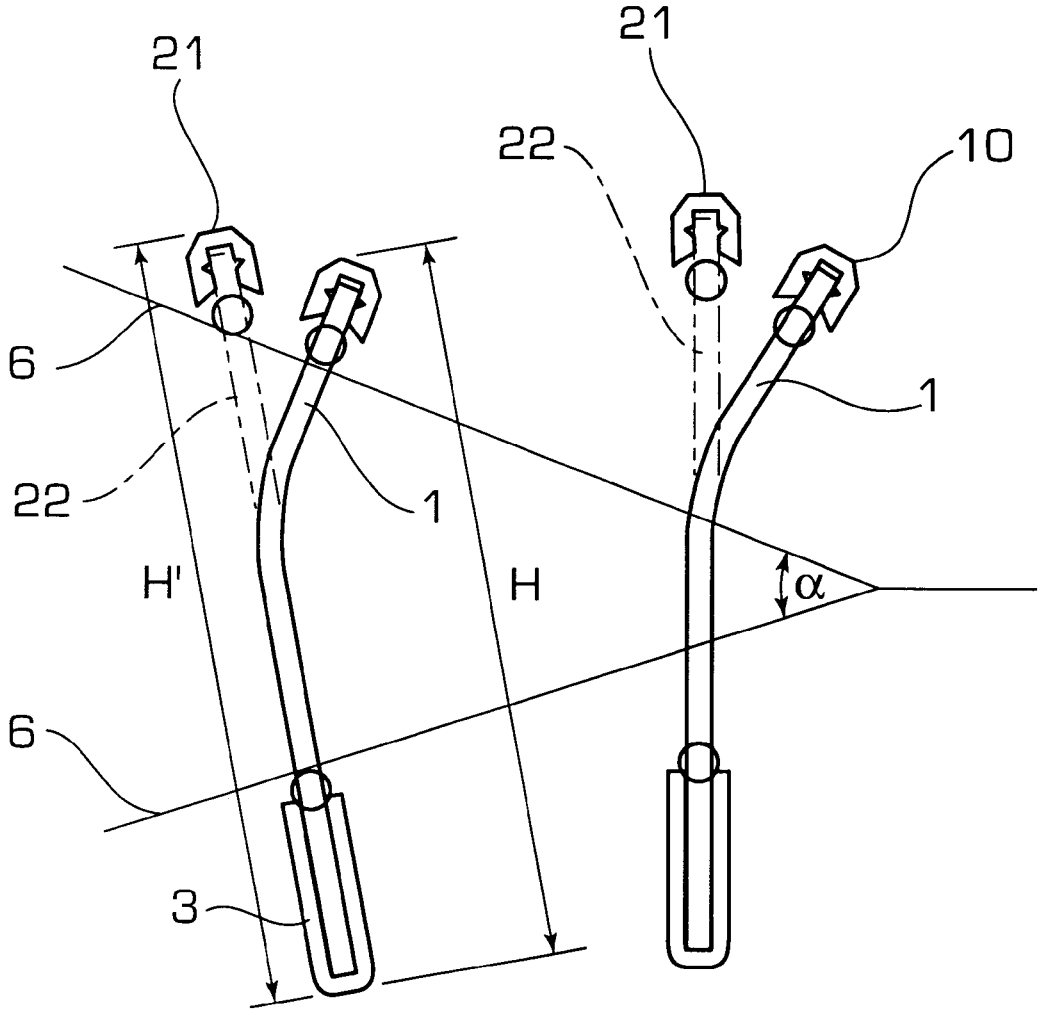

FIG. 1-b
PRIOR ART
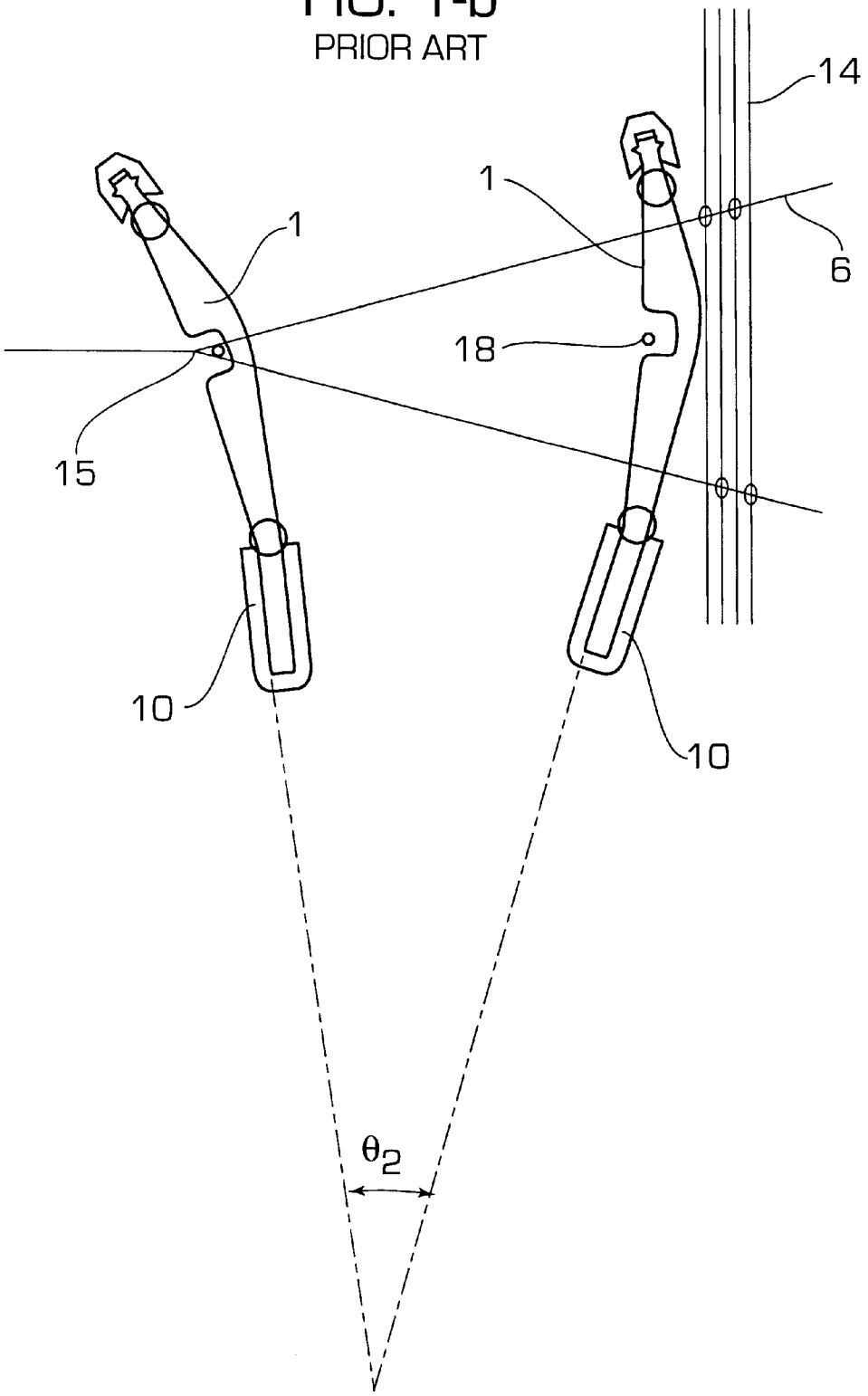

REED WITH DOGLEGGED BLADES FOR WATER JET LOOM AND WEAVING METHOD USING THE SAME

BACKGROUND OF THE INVENTION

1. Field of the Invention

The present invention relates to a reed for a water jet loom, which reed is used for weft insertion by feeding the weft by means of a stream of water ejected from a nozzle disposed in the water jet loom. Further, the present invention relates to a method of weaving a thermoplastic synthetic fiber fabric, using the above reed, and more specifically, to a method of weaving a thermoplastic synthetic fiber fabric using, as warps, soft-twisted multi-filament yarns composed of a polyester or some other thermoplastic synthetic fiber or substantially zero-twisted multi-filament yarns having interlaced tie points formed by interlacing and composed of a polyester or some other thermoplastic synthetic fiber.

2. Technical Background

As the weaving speed of a shuttleless loom increases, naturally, it is required to increase the reciprocation rate of the reed. However, when it is attempted to rock the reed at a high reciprocation rate, a large inertial force works on the reed. For controlling the occurrence of inevitable vibration, etc., caused by the above inertial force, it is therefore necessary to increase the rigidity of the reed or decrease the weight thereof.

A water jet loom, which permits the flying of a weft by means of ejected water and therefore can serve to decrease the shedding amount of warps, is advantageous in that the height (lengthwise dimension) of the reed can be decreased and that the reed can be decreased in weight. On the other hand, in an air jet loom and a rapier loom, increase of the shedding amount of warps is required more because the stability of flying of a weft is poor, and the above problems such as vibration, etc., caused by the reciprocation of the reed is therefore more serious. For decreasing the above problems of an air jet loom and a rapier loom having a large movement stroke of the reed, therefore, an attempt has been made to curve the upper portion of a reed blade as shown in FIG. 1-*a* so that the height (lengthwise dimension) of the reed and the weight thereof are decreased. Further, FIG. 1-*b* shows a side view of the reed used in an air jet loom.

Those advantages which are produced by decreasing the height of the reed will be explained in detail with reference to FIG. 1-*a* showing a state in which warps 6 are allowed to form a vertical open shed by forming a shedding angle $\alpha$ with a reed blade. When a reed blade 22 not curved toward the cloth-fell and shown by a chain line in the Figure and a reed blade 1 curved toward the cloth-fell and shown by a solid line in the Figure are compared, the following will be understood.

That is, since the warps 6 are vertically opened so as to form a shedding angle $\alpha$, the linear reed blade 22 is required to have a reed height H'. In contrast, for the reed blade 1 curved toward the cloth-fell so as to have the form of a "dogleg", a reed height H is sufficient. The reed can therefore be decreased in height, and it can be decreased in weight.

As is clearly shown in a geometrical relationship between the shedding angle $\alpha$ and the curved reed blade 1 in FIG. 1-*a*, however, the effect on the decreasing of the reed height H is high only when the shedding angle $\alpha$ is inevitably large like an air jet loom and a rapier loom. When the shedding amount of warps can be small like a water jet loom, i.e., when the shedding angle $\alpha$ is small, not only almost no effect is produced, but also there is an undesirable indirect influence that an additional production step is required for bending the reed blade toward the cloth-fell so that the production cost increases to that extent. It has been therefore not at all considered to produce a reed blade having a form bending toward the cloth-fell in a water jet loom.

In the reed of a water jet loom which is operated at a high speed, it is required to increase the reed blade in width or in thickness for overcoming problems caused by the above deficient rigidity. However, when the reed blade is increased in thickness on one hand, the space through which a warp passes is correspondently inevitably narrowed on the other hand. There are therefore caused problems that warps are abraded by reed blades and are liable to suffer damage such as a fluff, and further that the resistance against the actuation of the reed increases. Further, there is also another problem in that when the reed blade is increased in width, a larger amount of water is held among reed blades disposed side by side due to capillarity (surface tension) because of the inevitable requirement of a water jet loom that water is used for inserting wefts, so that a sizing agent adhering to wefts is dissolved off. If warps which lose the sizing agent due to the above action and are consequently free of a protective layer are abraded, the warps are more susceptible to damage, and naturally, the warps easily cause fluffing, and the like. Further, there is another problem that when a large amount of water is held among the reed blades, the water flows together with the rocking of the reed blades, which vibrates the reed blades.

Further, as conventional means of preventing the fluff of warps and warp breakage when a fabric using multi-filaments as warps is woven with a water jet loom having a small shedding amount, i.e., with a water jet loom having a straight-shaped reed, there have been employed a method in which a sizing agent is allowed to adhere to warps, a method in which warps are twisted, or a method in which warps are interlaced. Naturally, in a soft-twisted yarn of which the twisted count is small, some filaments alone of many filaments forming the-yarn are abraded by a heald and reed blades as compared with moderate-twisted and hard-twisted yarns, and the soft- twisted yarn is therefore liable to undergo filament breakage so that it is made difficult to weave a fabric. This is also true of a substantially zero-twisted filament yarn having interlaced tie point provided by interlacing. In view of fabric weaving, therefore, a moderate-twisted yarn and a hard-twisted yarn having a twisted count of 500 to 3,000 per meter do not easily undergo fluffing, and generally, they can be woven to a fabric without fixing filaments with a sizing agent. As far as soft-twisted yarns having a twisted count of less than 500 per meter are concerned, those soft-twisted yarns that have a relatively large twisted count can be relatively easily woven to a fabric by fixing their filaments with a sizing agent. In contrast, those soft-twisted yarns which have a twisted count of 300 or less and a substantially zero-twisted multi-filament yarn having tie points provided by interlacing are difficult to be woven to a fabric. A zero-twisted multi-filament yarn having neither twisting nor interlaced tie points is much more difficult to be woven to a fabric at a practical speed.

It has been long desired in the field of this art to overcome the above problems on the reed of conventional water jet looms, while no fundamental solution has been reached.

With a recent diversity of textile products, it is required to use finer filaments for fabrics of polyester fibers which are often used for coats required to be stylish, and fabrics using zero-twisted multi- filament yarns are also demanded. When these fabrics are woven, their weaving is carried out in a state where zero-twisted warp yarns are interlaced to form 10 to 60 interlaced tie points per meter so that the loosening of the filaments and the damaging of some filaments caused by the abrasion of the reed, etc., are avoided during the weaving. The interlaced tie points formed by the interlacing are untied during the weaving, and after the completion of the weaving, the number of the tie points per meter is several at the largest, so that a fabric similar to a fabric woven from zero-twisted yarns can be woven. However, even if the above means is employed, it is very difficult to weave a fabric using multi-filament yarns with a water jet loom, and there are problems that a fabric is poor in product quality since warps heavily abraded by water-adhering reed blades undergo filament breakage and that the operation of manufacturing machines is often discontinued due to yarn breakage.

SUMMARY OF THE INVENTION

It is an object of the present invention to provide a reed for water jet looms, which is remarkably free of the abrasion-induced damage of warps caused by reed blades and which can serve to perform stable weaving at a high weaving speed.

It is another object of the present invention to provide a method of more easily weaving, at a high weaving speed, a fabric of a thermoplastic synthetic fiber such as polyester yarns, etc., using nearly zero- twisted filament yarns.

According to the present invention, there is provided a reed for water jet looms, characterized in that said reed has reed blades whose upper portions have the form of being bent toward the cloth-fell in the form of a "dogleg" in a state where the reed blades are attached to the reed for a water jet loom.

According to the present invention, further, there is provided a method of weaving a fabric, characterized in that each weft is inserted into a weaving shed by means of a stream of ejected water in a state where the distance from a contact point of a reed blade and a warp when a reed reaches its retracting position to the cloth-fell is decreased by using the above reed in which reed blades is bent in the form of the above "dogleg", said warp being thermoplastic synthetic fiber multi-filament yarns each of which has a twisted count of at least 100 per meter or each of which is with interlaced tie points formed by interlacing and substantially zero-twisted.

BRIEF DESCRIPTION OF DRAWINGS

FIG. 1-*a* is a side view for explaining the reed height (H) in a rapier loom and an air jet loom, and FIG. 1-*b* is a side view of reed blades of the air jet loom.

DETAILED DESCRIPTION OF THE INVENTION

Figure 2:
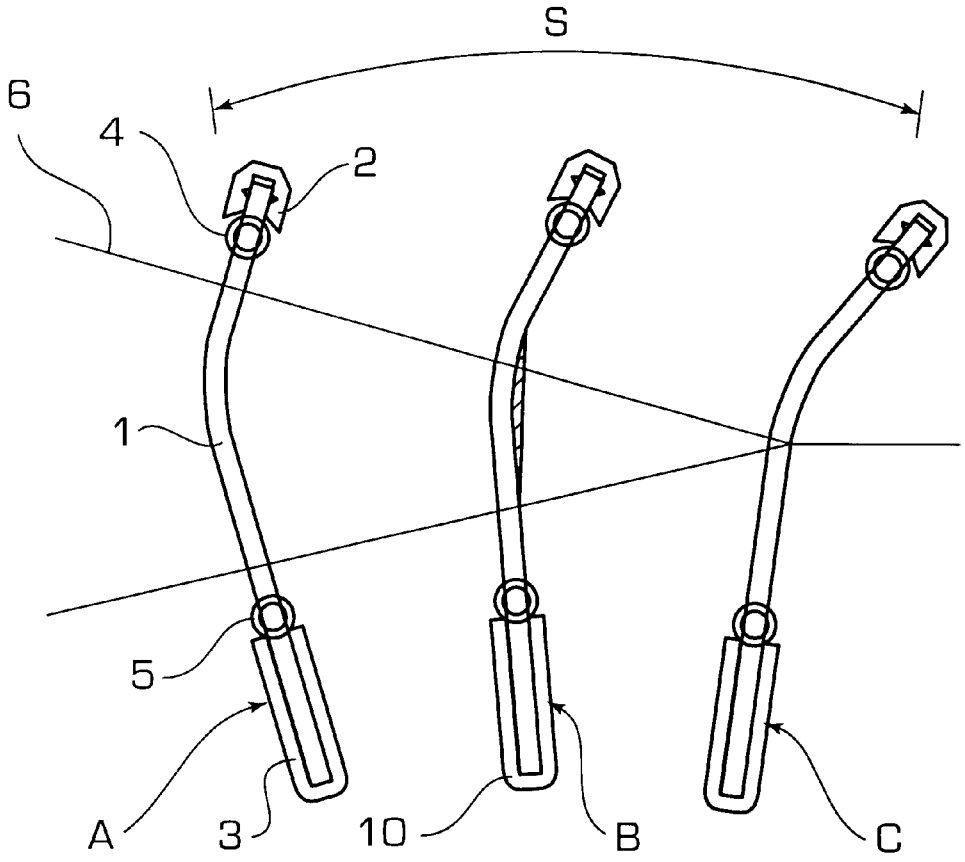
FIG. 2 is a side view of a reed blade attached to a water jet loom.

FIG. 2 is a side view illustrating one embodiment of the reed for a water jet loom according to the present invention. In the Figure, 1 indicates a reed blade, 2 indicates an upper channel, 3 indicates a reed blade holder, 4 and 5 indicate upper and lower coils, respectively, and 6 indicates a warp. The reed 10 for water jet looms, provided by the present invention, has a constitution comprising the above reed blade 1, the upper channel 2, the reed blade holder 3, the upper coil 4 and lower coil 5. The reed blade 1 is fixed to the upper channel 2 and the reed blade holder 3 in its top end and bottom end, respectively, and a number of such reed blades are disposed side by side in a vertical direction from the paper surface of FIG. 2 through upper coils 4 and lower coils 5 such that adjacent reed blades are held at predetermined intervals for threading warps. Further, the upper portion of the reed blade 1 has the form of being bent toward the cloth-fell in the form of a "dogleg" in a state where the reed blade 1 is attached to a reed for a water jet loom, and the depth of the upper portion along the warp threaded direction is arranged to be smaller than the depth of the lower portion. Further, the lower portion of the reed blade is fixed to the reed blade holder 3 in a state where the extending direction thereof is tilted in the counter direction against the cloth-fell.

In the Figure, symbols A, B and C show three positions of one reed blade which rocks drawing an arc indicated by S during the weaving. Symbol A shows a position in which the reed blade 1 is the farthest from the cloth-fell (a state where weft insertion is effected by means of water ejected from a water ejection nozzle), C is a position in which the reed blade 1 is the closest to the cloth-fell (a state where a weft is pressed to warps with the reed), and B shows an intermediate position between these A and C. It will be easily understood from the Figure that when the reed blade 1 rocks drawing an arc, a centrifugal force as inertial force accordingly works in a normal direction relative to the arc.

In the reed for water jet looms, which has the above constitution, the reed of the present invention has a characteristic feature in that the upper portion of the reed blade 1 is bent toward the cloth-fell (rightward in FIG. 2) in the form of a "dogleg" in a state where the reed blade 1 is attached to the reed. The "form of a "dogleg"" can be further defined as follows. The bending point is present above a point where the reed contacts the cloth-fell, and the upper portion of the reed is bent toward the cloth-fell. The position of the bending point is preferably in the range of 0.5 mm to 20 mm apart, particularly preferably 0.7 mm to 15 mm apart, from the cloth-fell. Further, the bending angle is preferably in the range of 20° to 45°, particularly preferably 25° to 40°.

In contrast, a conventional reed blade merely has a straight form as shown by a chain line in FIG. 1-*a*, and it does not show any creativity that the present invention has concerning the bending thereof toward the cloth-fell in the form of a "dogleg" and the arrangement of a dimensional difference between the depth of the upper portion and the depth of the lower portion of the reed blade.

The use of the reed of the present invention in place of the above conventional reed is based on the present inventors' finding below.

During studies the present inventors have diligently made on a water jet loom for increasing its weaving speed, it has been first found that one of major factors preventing the increasing of the weaving speed is that the direction in which an inertial force (centrifugal force) works on water held by reed blades and the direction in which the reed blades are linearly upwardly extending are concurrent when a conventional reed is used, due to the rocking (arc movement) of the reed blades. Further, the following has been also found. In the above conventional reed, water held among reed blades 1 by capillarity (surface tension) is forced to move upwardly due to an inertial force, while the upper channel 2 is present on the top end of each reed blade along which water is forced to move, so that the movement of the water is prevented by the above upper channels 2. The water held among the reed blades is therefore not smoothly removed off. Further, it has been revealed that water held among reed blades (1) elutes a sizing agent which works as a protective layer on warps threaded through among the reed blades so that the warps are abraded and damaged and that (2) the reed is increased in weight due to the water adhering to the reed blades and vibrated due to the motion (up and down movement along the reed blades) of the water which takes place with the rocking of the reed. And, on the basis of the finding of these, there has been devised a reed which is to permit the excellent removal of residual water held among reed blades, and the reed of the present invention has been accordingly arrived at.

When the above-discussed process and background which have led to the present invention are understood in detail, it can be easily understood that the reed of the present invention to be explained hereinafter has so many advantages as compared with any conventional reed.

That is, a conventional reed blade has the form of a structure in which it straightly extends in the direction in which a centrifugal force works and the upper channel which stops water is present in the extending direction of the reed blade. In contrast, in the reed blade 1 of the present invention, its upper portion is bent toward the cloth-fell in the form of a "dogleg", which plays an important role in the removal of water. The effect of the reed blade 1 bent in the form of a "dogleg", with regard to the removal of water, can be easily understood when two cases, a case where a centrifugal force works on water held in lower portions of the reed blades 1 and a case where a centrifugal force works on water held in upper portions thereof, are taken up separately.

That is, when the case where a centrifugal force works on water held in the lower portions of the reed blades 1 is taken up, water is ejected from a water jet nozzle (not shown) for weft insertion when the reed blades 1 are in the position A in FIG. 2, and water which is accordingly held among the reed blades 1 moves in the upper direction in which the reed blades 1 are extending, under the centrifugal force caused by the rocking (arc movement) of the reed 10. In this case, since the upper portion of each reed blade 1 is bent in the form of a "dogleg", a barrier, such as the upper channel 2, which plays a role in stopping water which is forced to upwardly move further from the bending portion, is no longer present. Therefore, water held in the lower portions of the reed blades 1 is directly shaken off from the reed blades in the bending portions under the centrifugal force.

When the latter case where a centrifugal force works on water held in the upper portions of the reed blades 1 is taken up, in the present invention, the direction of the centrifugal force which works on water under the rocking (arc movement) of the reed 10 and the direction in which the upper portions of the reed blades are extending are not to be in agreement, which devising plays a very important role. That is, water held among the reed blades 1 naturally moves in the normal direction (radius direction of an arc) of a locus (arc) along which the reed blades move, under the centrifugal force working on the water. In this case, if there is used a conventional reed having reed blades present in the working direction of a centrifugal force working on water, water simply moves upwardly along the reed blades, is directly stopped by the upper channels and is continuously held by the reed blades, as is already discussed. That is, for preventing water held among reed blades from remaining directly on the reed blades, the working direction of the centrifugal force and the extending direction of the reed blades should not be in agreement. The reed blades 1 used in the present invention are therefore shaped so as to have the form of being bent toward the cloth-fell in the form of a "dogleg", whereby the direction in which water can move while being constrained under the surface tension with the reed blades 1 and the working direction of a centrifugal force are distinctly different. Owing to this device, water held among the reed blades 1 is released from the constraint under the surface tension with the reed blades 1, and is consequently shaken off from the backside edges (edges opposite to the cloth-fell, in the threading direction of warps) of the reed blades 1 under the centrifugal force.

In a preferred embodiment of the reed of the present invention, the depth of the upper portion of each reed blade 1 along the warp-threaded direction is arranged to be smaller than the depth of the lower portion.

Therefore, when water adhering to the lower portion side of the reed blades 1 under the action of surface tension (capillarity) moves from the lower portion side to the upper portion side under the effect of the centrifugal force, there is caused a sharp decrease in the power of the water adhering to the reed blades 1 as the depth sharply decreases. Water adhering to the reed blades 1 is therefore easily shaken off from the reed blades 1 under the action of the centrifugal force, and water held on the upper portion side can be therefore decreased in amount.

As is clear from a state where the reed blade 1 rocks drawing an arc in FIG. 2, the force exerted on the root (lower end) of each reed blade is larger than the force on an upper end, and therefore, the reed blade is required to have high strength and high rigidity. In the reed 10 of the present invention, particularly, the depth of the lower portion of each reed blade 1 can be arranged to be greater than the depth of the upper portion, and the strength and the rigidity can be therefore sufficiently secured. Further, since the depth of the upper portion can be narrowed so that the reed blades 1 can be decreased in weight. Eventually, the reed itself can be decreased in weight.

Further, in another preferred embodiment of the present invention, the extending direction of the lower portion of each reed blade 1 is tilted opposite to the cloth-fell, and the lower end of each reed blade 1 is fixed to the reed blade holder. In this structure, the front surface when viewed from the cloth-fell side is dented in the form of a "dogleg" (hatched portion in FIG. 2), so that the dent in the form of a "dogleg" can be allowed to play a role as a guide space for smoothly flying a weft when the weft is fed in the open shed by means of ejected water. Naturally, therefore, the weft insertion is stably accomplished.

The effect of the method of weaving a thermoplastic synthetic fiber fabric, using the above reed in a water jet loom, will be explained hereinafter with reference to FIGS. 3 and 4.

The method of the present invention uses the reed in the form of a "dogleg" as means of preventing warp fluffing and warp breakage. FIG. 3 is a schematic side view showing differences between the weaving method of the present invention and a conventional weaving method using a straight-shaped reed. The reed 10 bent in the form of a "dogleg", used in the present invention, is shown by a solid line, and the conventional straight-shaped reed 21 is shown by an imaginary line. Further, with regard to the reeds 10 and 21, beating up positions and retracting positions are shown, and it is shown that the rocking angle θ is the same as that in the conventional method.

The first feature of the weaving method of the present invention is that the abrasion stroke S of the reed blade 1 relative to the warp 6 of the open shed can be remarkably decreased as compared with the abrasion stroke T in the conventional method. That is, the upper portion of the reed blade 1 is bent toward the cloth-fell 15 in the form of a "dogleg", whereby the contact point 16 of the reed blade 1 and the warp 6 when the reed is retracted can be allowed to come closer to the cloth-fell side than a contact point 23 when the conventional straight-shaped reed blade 22 is used. On the other hand, since the position where the reed blade contacts the cloth-fell does not differ from that in the conventional method, the abrasion stroke of the reed blade 1 relative to the warp 6 can be decreased, and, since that portion which is decreased is on the top end side of the reed blade, i.e., a portion which abrades warps at a higher rate, the damage of warps caused by the abrasion with the speed, blade can be decreased more than it is decreased to an extent that the abrasion stroke is decreased.

Figure 3:
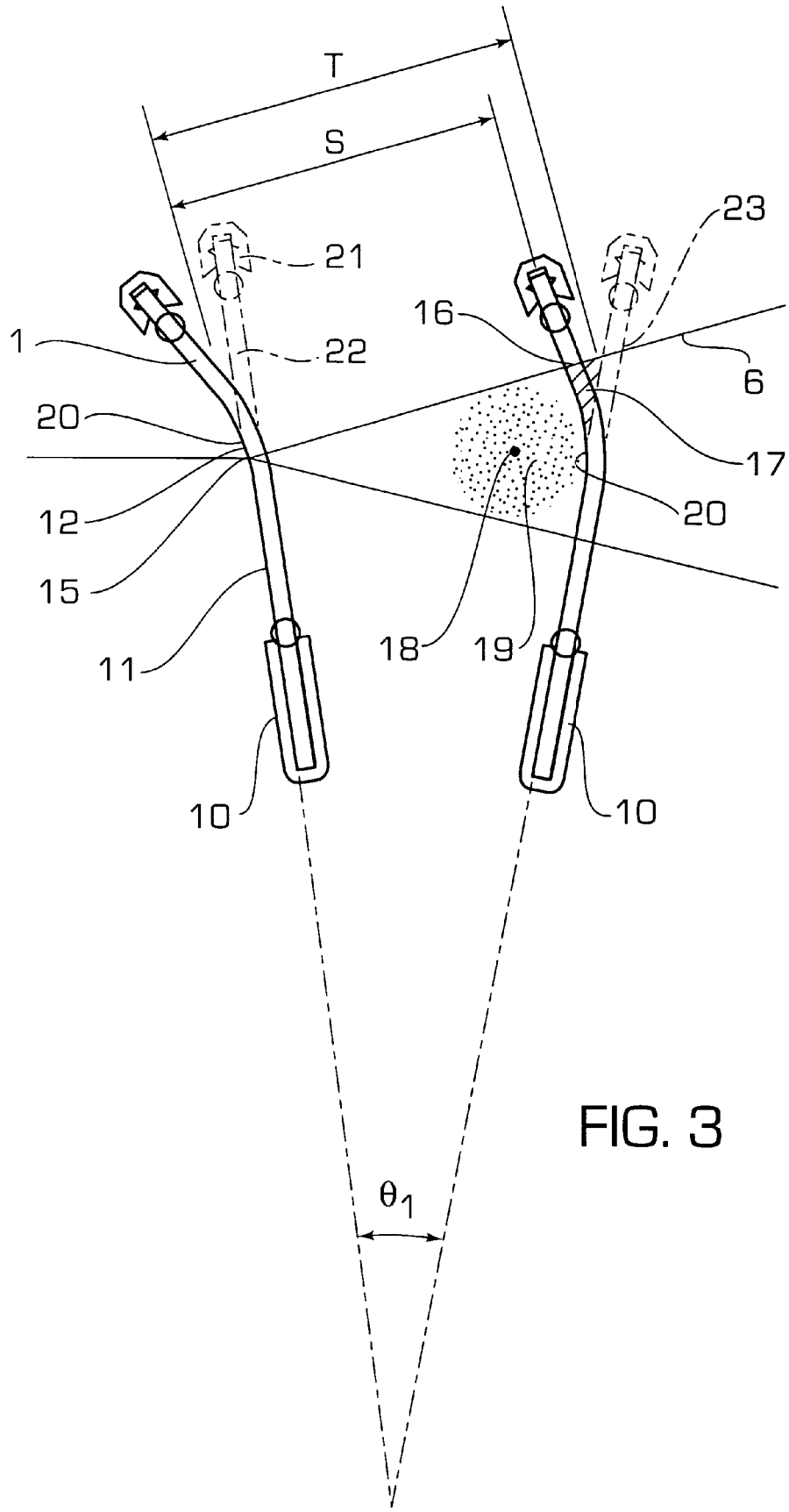
FIGS. 3 and 4 are side views for explaining differences between the weaving method of the present invention and a conventional weaving method.

On the other hand, in the example shown in FIG. 3 in which the rocking angles $\theta_1$ are the same, the flying passage of wefts is made smaller by a region 17 indicated by slanting lines. Since, however, the stream of ejected water transporting a weft 18 is diffused in a circular region with the weft being its center, the region 17 indicated by slanting lines is a portion which from the beginning does not much effectively function as a passage for a stream 19 of transporting ejected water and the weft 18, and a decrease in cross-sectional area caused by the bending of the read blade 1 in the form of a "dogleg" causes almost no barrier against the weft insertion. To the contrary, the weft passage has the form close to a circle which is the convergence of a stream of ejected water, and therefore, water drops which exist in a peripheral area of the diffusion and do not work to transport the weft are dissipated by their collision with the reed blade 1. Effectively enough, the damage of the weft caused by the water drops which are diffused in the peripheral area and collide with the weft is decreased. That is, the second feature of the weaving method of the present invention is that since the upper portion of each reed blade is bent in the form of a "dogleg", water drops which are immensely diffused upwardly and do not serve to transport the weft collide with the bent reed blades to be dissipated, whereby the damaging of the weft by the direct collision of water drops having a high velocity with the weft can be decreased.

The front edge of the bending portion of the reed blade which is bent in the form of a "dogleg" forms an arc-shaped portion 20. The position which is to collide with the cloth-fell at a beating up is arranged to be a position a little lower than a contact point 12 of a straight line portion 11 beneath the front edge of the reed blade and the above arc-shaped portion 20, whereby the weft passage at a weft insertion time can be adjusted to a form encircling a circular stream of ejected water by the form of a "dogleg" of the reed blades 1 without changing the rocking angle and position of a slay sword.

Figure 4:
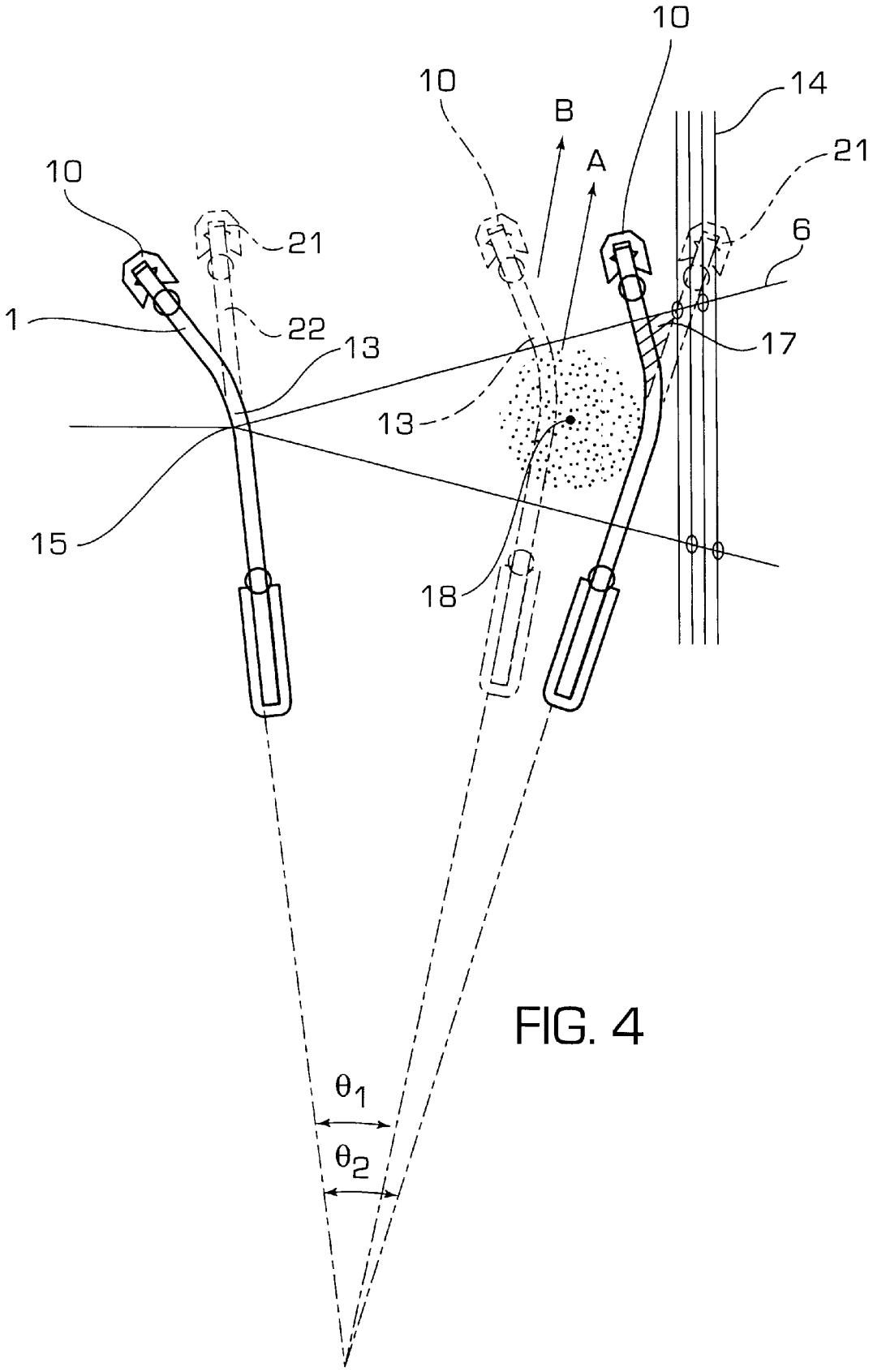

FIG. 4 is given for explaining that the above effect of the present invention can be sufficiently exhibited even if the rocking angle $\theta_2$ of the reed is made greater than the rocking angle $\theta_1$ in the conventional method. In the embodiment shown in FIG. 4, the reed 10 having reed blades 1 bent in the form of a "dogleg" is used, and the rocking angle $\theta_2$ of the slay sword to which the reed is attached is made greater, to some extent, than the rocking angle $\theta_1$ in the conventional method. In this case, the decrement 17 of the weft passage caused by the bending of the upper portion of the reed is compensated by an increase in the weft passage in the lower portion of the reed blade, which increase is brought by increasing the rocking angle of the slay sword, and the weft passage is greater than that in the embodiment in FIG. 3 so that the weft insertion can be eased. Even in this case, the abrasion stroke of the reed blade 1 against the warp 6 in an upper portion of an open shed can be made by far smaller than that in a case using a straight-shaped reed blade 22, and owing to the bent reed blades, ejected water which is immensely deviated upwardly above the weft 18 can be dissipated by allowing it to collide with the upper portion of each reed blade bent in the form of a "dog leg". Therefore, the same effect as is explained concerning the FIG. 3 can be exhibited, and the damage of the warp 6 can be remarkably decreased.

Further, the weaving method of the present invention has the third feature that the amount of water held among the reed blades can be remarkably decreased, and that the damage of warps caused by the crossing of the warps through water held among reed blades at a high velocity can be decreased, by the characteristic of the above reed bent in the form of a "dogleg", i.e., the characteristic that water held among the reed blades in a position lower than the bending point of each reed blade is shaken off backward from the reed (opposite to the cloth-fell) in the bending portion 13 of each reed blade by a centrifugal force which occurs with the rocking of the reed blades and works in the direction of an arrow A in FIG. 4.

According to the method of the present invention, further, the interference between the top end of the reed 10 and a heald 14 comes to be avoidable, so that the distance between the heald 14 and the cloth-fell 15 can be decreased and that the up and down stroke of the heald 14 for obtaining an identical open shed of warps can be made smaller than that in the conventional method. The method of the present invention therefore has the fourth feature that the damage of warps can be decreased in the above point as well.

The above features more effectively work on soft-twisted multi-filament yarns of which some filaments alone are damaged due to the abrasion with the reed 10 and the heald 14 and of which the filaments are liable to be loose due to the collision of water drops and the crossing thereof through water held among reed blades and substantially zero-twisted multi-filament yarns having similar disadvantages and having interlaced tie points formed by interlacing. Therefore, the use of the method of the present invention enables the easy weaving, at a high velocity, of thermoplastic synthetic fiber fabric using soft-twisted warps or substantially zero-twisted warps which have twisted counts of at least 100 per meter of sizing-agent-free having interlaced tie points formed by interlacing, without damaging the warps.

According to the weaving method of the present invention, wefts are not crimped and flying wefts therefore show less meandering so that the open shed of warps can be decreased. Therefore, the above effects of the present invention can be more efficiently exhibited.

The present invention will be more specifically explained with reference to Examples hereinafter.

EXAMPLE 1

A weaving test was carried out by the use of a water jet loom on which a reed provided with reed blades having a form similar to the reed blade shown in FIG. 2 is mounted. In this case, the depths of the reed blades in the threading direction of warps were 2.2 mm in an upper portion and 3 mm in a lower portion, and the number of reed blades per inch was 48 reed blades/inch. The bending angle of the upper half relative to the lower half of each reed blade for shaping the form of a "dogleg" was 300. The contact position of the front surface of the reed to the cloth-fell was set at a position 1 mm lower from a point where the arc (R portion) of the bending portion of the reed and the straight line of the lower half of the reed met with each other.

In the weaving test using the above apparatus, zero-twisted polyester filament yarns having a size of 50 denier/24 filaments, 30 interlaced tie points per meter and no sizing agent were used as warps, substantially zero-twisted polyester filament yarns having a size of 75 denier/36 filaments were used as wefts, and a taffeta fabric was woven at a loom rotation of 800 rpm. In the present invention, the number of times of discontinuation (times/day-number of looms) of looms was used as a factor for quantitatively determining the effects, and the looms were studied for the number of times of discontinuation (times/day-number of looms).

As Comparative Example, with regard to a conventional reed having straight reed blades, looms were studied for the number of times of discontinuation (times/day-number of looms) under the same conditions as those in Example 1 except the reed (see Table 1).

TABLE 1

| | Comparative Example | Example |
|---|---|---|
| Discontinuation caused by warps | 0.5 | 0.1 |
| Discontinuation caused by wefts | 0.2 | 0.2 |
| Discontinuation caused by loom | 2.1 | 0.4 |
| Discontinuation caused by other factors | 0.6 | 0.5 |
| Total | 3.4 | 1.2 |

As is clearly shown in Table 1, it is seen that when the reed of the present invention was used, the number of times of discontinuation caused by warps and a loom remarkably decreased as compared with the conventional reed. Further, when the discontinuation caused by warps was closely studied for causes, it was found that the warps were abraded to be broken, and the effect of the use of the reed of the present invention was clear. Further, when woven fabrics were studied, the number of fluffing on warps in the present invention decreased as compared with the conventional reed although not shown in Table 1. Further, when the content of the discontinuation caused by looms was studied in detail, the discontinuation was caused by the tangling of leading end of wefts inserted into the open shed of warps and a decrease in turning, and it was found that the reed of the present invention had an effect on the stability of flying of wefts as compared with the conventional reed.

As explained above, when the reed of the present invention is used, water held among the reed blades can be remarkably effectively removed off, the reed can be decreased in weight, and even when warps have an sizing agent, the elution of the sizing agent in water held among the reed blades can be remarkably inhibited. Therefore, there are produced remarkable effects that the reed weight which controls the velocity of the weaving rate of a water jet loom can be decreased, that the occurrence of vibration caused by the up and down movement of water held among reed blades can be remarkably decreased, further that the elution amount of a sizing agent remarkably decreases, and that warps do not cause the fluffing or breakage under the abrasion of reed blades.

Further, when the lower end of the reed blade is fixed to a reed blade holder in a tilted state, a broader guide space for introducing a flying weft in the weft insertion can be formed, whereby there is produced an effect that the stable weft insertion is accomplished.

EXAMPLE 2

A polyester filament fabric having a weft density of 47 wefts/inch was woven at a loom rotation of 750 rpm by the use of a reed (density: 19 blades/cm) having reed blades which had a form similar to that of the reed blade shown in FIG. 2 and of which the upper portions were bent toward the cloth-fell at 35° in the form of a "dogleg" and had a smaller width than the lower portions thereof, using, as warps, zero-twisted and sizing-agent-free polyester filaments having a size of 50 denier/24 filaments and having 25 interlaced tie points per meter and, as wefts, substantially zero-twisted polyester filaments having a size of 75 denier/36 filaments. The number of times of discontinuation of looms per one machine for 1 day 24 hours was as shown in Table 2, and the use of the reed bent in the form of a "dogleg" is high.

TABLE 2

| | Bent reed | Conventional reed |
|---|---|---|
| Discontinuation caused by warps | 0.2 | 0.5 |
| Discontinuation caused by wefts | 0.2 | 0.3 |
| Discontinuation caused by loom | 0.6 | 1.8 |
| Discontinuation caused by other factors | 0.4 | 0.5 |
| Total | 1.4 | 3.1 |

EXAMPLE 3

A polyester filament woven fabric was produced at a loom rotation of 700 rpm by the use of a reed (density: 18.5 blades/cm) having reed blades of which the upper portions were bent toward the cloth-fell at 33° in the form of a "dogleg" as in Example 2 and had a smaller width than the lower portions thereof, using, as warps, filaments prepared by allowing a polyacrylic sizing agent to adhere to substantially sizing agent-free polyester filaments having a size of 75 denier/72 filaments and 7 interlaced tie points per meter and being not twisted except twisting by unwinding, and as warps, polyester filaments of the same kind having a size of 75 denier/72 filaments. The number of times of discontinuation of looms were as shown in Table 3. The number of times of discontinuation of looms can be remarkably decreased as compared with a case using a conventional reed.

TABLE 4

| | Bent reed | Conventional reed |
|---|---|---|
| Discontinuation caused by warps | 0.3 | 0.9 |
| Discontinuation caused by wefts | 0.2 | 0.2 |
| Discontinuation caused by loom | 0.4 | 1.8 |

TABLE 4-continued

| | Bent reed | Conventional reed |
|---|---|---|
| Discontinuation caused by other factors | 0.6 | 0.7 |
| Total | 1.5 | 3.6 |

EXAMPLE 4

A nylon filament fabric having a weft density of 30 wefts/inch was woven at a loom rotation of 900 rpm by the use of a reed (18 blades/cm) having reed blades of which the upper portions were bent toward the cloth-fell at 30° in the form of a "dogleg" as in Example 2, using, as warps, a filament yarn prepared by applying a twist of 300 T/M to a nylon filament yarn having a size of 70 denier/108 filaments and further allowing 3.5% by weight of a polyacrylic sizing agent to adhere to it and as warps, a nylon filament yarn of the same kind having a size of 70 denier/108 filaments. The number of times of discontinuation of looms were as shown in Table 4, and the number of times of discontinuation of looms was remarkably decreased as compared with a case using a general reed. This is because the length in which the warps were abraded by the reed decreased by 7%, and the occurrence of fluffing of the warps was prevented. Further, of streams ejected from a nozzle, streams other than streams required for transporting the weft collided with the upper portion of the bent reed to form a mist, and contacted the warps very softly, so that streams which conventionally caused a warp streak phenomenon by colliding with warps to disturb the arrangement of the warps disappeared, and the fabric was improved in quality.

TABLE 4

| | Bent reed | Conventional reed |
|---|---|---|
| Discontinuation caused by warps | 0.3 | 0.9 |
| Discontinuation caused by wefts | 0.2 | 0.2 |
| Discontinuation caused by loom | 0.4 | 1.8 |
| Discontinuation caused by other factors | 0.6 | 0.7 |
| Total | 1.5 | 3.6 |

INDUSTRIAL UTILITY

According to the present invention, there is provided a reed for water jet looms, which is remarkably free from causing the abrasion damage of warps caused by a reed and which can accomplish stable and high-velocity weaving capability. Owing to water jet looms using the above reed, thermoplastic synthetic fiber fabrics of polyester yarns, etc., using almost no-twisted multi- filaments, can be woven easily at a high velocity, and the industrial significance thereof is great.

What is claimed is:

1. A water jet loom having a reed with a plurality of reed blades, each having an upper portion doglegged toward a cloth-fell relative to a lower portion, wherein the front edges of the upper and lower portions facing the cloth-fell each have a substantially flat outline.

2. A water jet loom as set forth in claim 1, having reed blade holders for fixing lower ends of the reed blades and wherein the lower portion of each reed blade is tilted opposite to the cloth-fell.

3. A method for weaving a thermoplastic synthetic fiber fabric comprises:

providing a water jet loom, wherein a reed attached to the water jet loom has reed blades having an upper portion doglegged toward a cloth-fell relative to each lower portion, and the front edges of the upper and lower portions facing the cloth-fell have a substantially flat outline;

preparing warps of thermoplastic synthetic multi-filament yarns each of which has a twisted count of at least 100 per meter or each of which is provided with interlaced tie points formed by interlacing and substantially zero-twist; and inserting a weft into a weaving shed with a stream of ejected water, wherein when the reed reaches its retracted position, a distance between the cloth-fell and a contact point with a warp by a reed blade is decreased by using the doglegged reed.

4. A method for weaving a thermoplastic synthetic fiber fabric as set forth in claim 3, wherein the weft is a substantially zero-twisted thermoplastic synthetic multi-filament yarn which is not crimped, and the weaving is carried out under a loom rotation of at least 550 rpm.

5. A method for weaving a thermoplastic synthetic fiber fabric as set forth in claim 3, wherein the warp is a substantially zero- twisted sizing-agent-free polyester multi-filament yarn having 10 to 60 interlaced tie points per meter formed by interlacing.

* * * * *